United States Patent [19]

Brendel et al.

[11] Patent Number: 5,033,373

[45] Date of Patent: Jul. 23, 1991

[54] APPARATUS AND PROCESS FOR PRODUCING A SMOOTH AND GLOSSY SURFACE ON A PAPER WEB

[75] Inventors: Bernhard Brendel, Grefrath; Klaus Kubik, Krefeld, both of Fed. Rep. of Germany

[73] Assignee: Eduard Küsters Maschinenfabrik GmbH & Co. KG, Krefeld, Fed. Rep. of Germany

[21] Appl. No.: 347,253

[22] Filed: May 3, 1989

[30] Foreign Application Priority Data

May 6, 1988 [DE] Fed. Rep. of Germany ..... 3815463

[51] Int. Cl.[5] ..... B30B 13/00; B30B 3/04; D21G 1/00

[52] U.S. Cl. ..... 100/38; 100/35; 100/93 RP; 100/161; 118/60; 118/69; 162/206; 162/361; 427/361

[58] Field of Search ..... 100/38, 35, 93 RP, 92, 100/161; 162/205-207, 358, 360.1, 361; 118/60, 69; 427/361, 365, 366

[56] References Cited

U.S. PATENT DOCUMENTS

| | | | |
|---|---|---|---|
| 1,291,626 | 1/1919 | Parks | 100/38 |
| 1,714,261 | 5/1929 | Egan et al. | 100/93 RP X |
| 2,251,890 | 8/1941 | Montgomery | 162/206 |
| 3,124,504 | 3/1964 | Mahoney et al. | 162/206 |
| 3,254,593 | 6/1966 | Beachler | 100/38 |
| 4,277,524 | 7/1981 | Nakajima et al. . | |
| 4,605,366 | 8/1986 | Lehmann et al. | 100/93 RP X |
| 4,606,264 | 8/1986 | Agronin et al. | 100/38 |
| 4,624,744 | 11/1986 | Vreeland . | |
| 4,653,395 | 3/1987 | Verkasalo | 162/206 X |
| 4,738,197 | 4/1988 | Malkia | 100/38 |

FOREIGN PATENT DOCUMENTS

| | | | |
|---|---|---|---|
| 2059533 | 6/1972 | Fed. Rep. of Germany | 100/93 RP |
| 3600033 | 7/1986 | Fed. Rep. of Germany . | |
| 675452 | 7/1952 | United Kingdom | 427/361 |
| 953713 | 4/1964 | United Kingdom | 427/361 |

OTHER PUBLICATIONS

"Temperature-gradient Calendering", R. H. Crotogino Tappi Journal, Oct. 1982, vol. 65, No. 10, 97-101.

*Primary Examiner*—Harvey C. Hornsby
*Assistant Examiner*—Stephen F. Gerrity
*Attorney, Agent, or Firm*—Kenyon & Kenyon

[57] ABSTRACT

A process for producing a smooth and glossy surface on a paper web and a calender arrangement for carrying out the process are disclosed. The calender arrangement comprises two sets of rolls through which the paper web is conducted in succession. Each set of rolls comprises a highly heated hard roll and a soft roll. A cooling device arranged upstream of at least one of the nips formed between the roll sets restricts the amount of heat transfer to the inner layers of the paper web and the attendant, undesirable partial plasticization of the inner layers of the web.

20 Claims, 1 Drawing Sheet

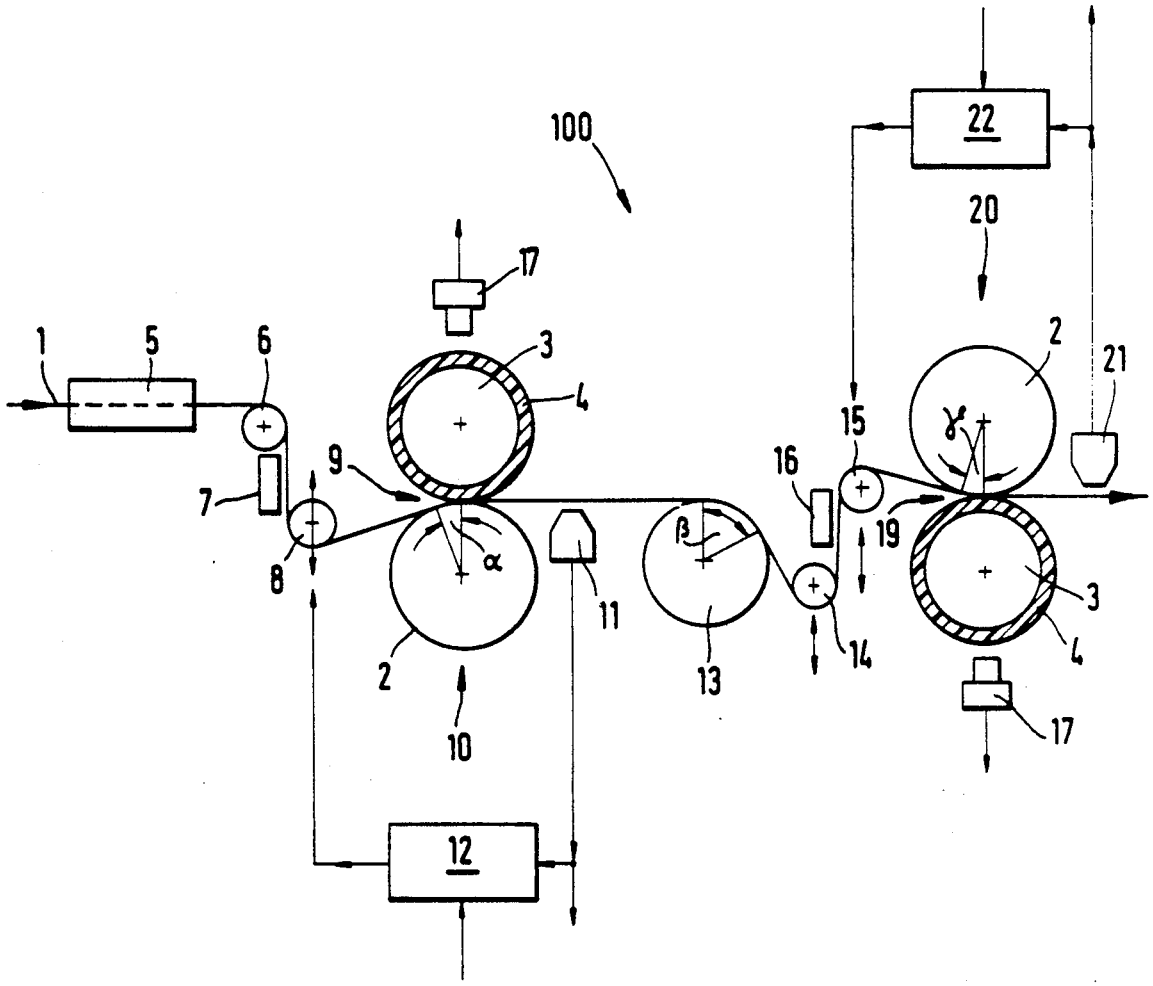
100
1
5
6
7
8
9
3
4
17
2
10
α
11
12
β
13
14
16
15
19
20
22
21
γ

APPARATUS AND PROCESS FOR PRODUCING A SMOOTH AND GLOSSY SURFACE ON A PAPER WEB

BACKGROUND OF THE INVENTION

The invention generally relates to a process for producing a smooth and glossy surface on a paper web, as well as a calender arrangement for carrying out such a process and, more specifically, to an improved process and calender arrangement in which the gloss effect is intensified without reducing the bulk of the web.

A similar process and calender arrangement is disclosed in German Published Patent Application 3600033. The calendar arrangement comprises two sets of rolls forming respective nips or roll gaps through which the paper web is conducted in succession. The rolls of these sets are arranged such that the hard roll of the first set of rolls presses against the paper web from one side and the hard roll of the second set of rolls presses against the web from the other side. Thus, the paper web receives the same treatment and surface formation on both sides. The hard roll, i.e., the steel roll, is heated in both sets of rolls to the minimum temperature at which the fibers of the paper web begin to deform. For paper, this temperature is approximately 175° C. The high temperature produces a paper web having improved gloss without a considerable loss of specific volume, which is defined as volume per gram of paper mass and corresponds to the reciprocal value of density. A similar arrangement is disclosed in U.S. Pat. No. 4,624,744.

The calendering action that occurs when steel rolls are heated to high temperatures is referred to as temperatures gradient calendering in R. H. Crotogino's article in the "TAPPI" Journal, Vol. 65, No. 10 (Oct. 1982) at pages 97–101. As the paper web contacts a very hot roll when passing through the roll gap or nip, the fibers near the surface of the web are heated to a temperature at which they begin to become partially plasticized. As is well known, the fibers are hollow. They become permanently flattened in the partially plasticized state, which evens out the surface of the paper web. Naturally, the flattening is reinforced by the friction that occurs when the paper web is conducted against a "soft" roll coated with paper or plastic. Heat conduction from the outer layers of the paper web to the inner layers is a time dependent transfer process; in the short time that it takes for the web to pass through the nip, no considerable rise in temperature takes place in the inner layers. Thus, the temperature at the inner layers remains low such that the inner fibers do not become partially plasticized. Rather, these fibers retain their elasticity and, after passing through the gap, once again assume their former shape. Therefore, the plasticization is restricted to the outer surface layers of the web. This process generally achieves the desired effect of producing a smooth and glossy surface on the paper web, without compressing the web as a whole, by the plasticization of all its layers, to a compact mass having a low specific volume and poor quality.

SUMMARY OF THE INVENTION

The invention is directed to the problem of further intensifying this gloss producing effect on the surface of the web, without reducing the "bulk" of the web, i.e., without reducing the specific volume inside the web.

The invention solves this problem by providing a process for producing a smooth and glossy surface on a paper web in a calender arrangement having at least one set of rolls, including a soft roll and a hard roll forming a nip therebetween through which the paper web is conducted, comprising the steps of a) heating the hard roll to a temperature at which noticeable plasticization of surface fibers of the paper web occurs as the paper web is conducted through the nip; b) cooling the paper web before it is conducted into the nip; and c) at least partially plasticizing surface fibers on one side of the paper web by heat transfer from the heated hard roll as the web is conducted through the nip.

The cooling step increases the temperature gradient between the hot outer surface of the hard roll and the inner layers of the paper web such that the temperature of the inner layers never reaches the temperature range at which the gloss intensifying, partial plasticization of the fibers occurs. On the contrary, with the process of the invention the plasticization effect remains completely isolated to the layers near the surface of the web such that the interior of the paper web retains its specific volume and exhibits good opaqueness and printability.

The cooling of paper webs that are treated to produce a smooth and glossy surface is disclosed, per se, in U.S. Pat. No. 4,277,524. However, in this patent cooling is not performed to produce an effect on the fibers of the paper web. Rather, the paper web is coated with a synthetic resin emulsion, which after being plasticized when conducted through a first nip is cooled for hardening before it is conducted through a second nip, thereby resulting in an especially intensified gloss on the coating.

The withdrawal of heat during the cooling step of the invention may occur on one side or on both sides of the web. However, the cooling must occur to such a degree that heat is noticeably withdrawn from even the inner areas of the paper web.

According to another aspect of the invention the paper web is not cooled before it enters into the nip, but rather is cooled in the nip itself by heat transfer from the side of the web contacting a cooled soft roll. Regardless of how cooling occurs, the smoothing effect of the highly heated hard roll may be reinforced by an additional step of heating the side of the paper web to be smoothed, before it enters the nip. Thus, while the cooling steps of the invention serve to retain the bulk inside the paper web, the additional heating step intensifies the gloss or plasticization effect of the hard roll as a result of the increased surface temperature. The additional surface heating, naturally, should be restricted to the surface of the web to ensure that the beneficial effects achieved from cooling the web are not nullified. This is especially a concern at high operating speeds because at these speeds it may be difficult to achieve the required temperature rise in the short time period that the paper web makes contact in the nip with the highly heated hard roll.

A further aspect of the invention relates to a calender arrangement for producing a smooth and glossy surface on a paper web comprising a first set of rolls forming a first nip therebetween through which a paper web is conducted, the rolls including a soft roll and a hard roll adapted to be heated to a predetermined temperature at which noticeable plasticization of surface fibers of the paper web occurs as the web is conducted through the nip, and a first cooling device for cooling the paper web. The cooling device may be formed as a separate cooling apparatus disposed upstream of the first nip with respect to the direction of travel of the paper web for cooling the web before it enters the first nip. Alternatively, the soft roll may be formed as a cooled roll, which per se are known in the art (see, e.g., U.S. Pat. No. 4,277,524), for cooling the web as it is conducted through the nip.

In instances in which it is desirable to smooth both sides of the paper web, two sets of rolls may be provided, with each set forming a respective nip. The paper web is conducted through the nips in succession as depicted in German Published patent Application 3600033. provision of a cooling device disposed upstream of at least the second nip with respect to the direction of travel of the web for cooling the paper web advantageously counteracts the temperature rise in the inner areas of the Web caused by treatment of the web in the first nip and the attendant penetration of heat into the paper web. Even more beneficial effects may be realized by arranging a second cooling device upstream of the first nip such that the web is cooled before entering both nips. The cooling devices may comprise cool air blowers for blowing cool air against the outer surface of at least one side of the web, cooled rolls for cooling the web as it is conducted over the cooled roll or one of each.

As mentioned above, the smoothing effect of the highly heated hard roll may be reinforced if a certain amount of heat is applied to the side of the paper web to be smoothed before it enters the nip. This may be accomplished by provision of a heating device disposed upstream of the nip. The heating device may comprise a radiant heating arrangement, a hot air blower for blowing hot gases onto the web or a heated roll that conducts heat to the web as it is conducted over the heated roll.

In accordance with the type of paper web to be treated, the desired pretreatment and moisture content of the paper web, as well as the operating speed and pressure in the nips, careful control of the transferred quantities of heat is required. To the extent that these quantities of heat are withdrawn from or applied to the paper web by heated or cooled rolls, the required control may be accomplished by provision of a selectively movable guide roller disposed upstream of the nip for adjusting the angle over which the web is looped over the heated or cooled roll. This, in turn, adjusts the time that the web contacts the roll and, hence, the amount of heat that is transferred.

Further features, advantages and embodiments of the invention are apparent from consideration of the detailed description, drawing FIGURE and the appended claims.

BRIEF DESCRIPTION OF THE DRAWING

The sole drawing FIGURE shows a side view of a calender arrangement constructed according to the principles of the invention.

DETAILED DESCRIPTION

The calender arrangement 100 comprises two sets of rolls 10 and 20 through which the paper web 1 is conducted in succession. Each set of rolls includes a highly heated steel roll 2 having a surface temperature in the range of 150 to 250° C., and a "soft" roll 3, i.e., a roll provided with a paper or plastic coating 4. In the first set of rolls 10, the highly heated steel roll 2 presses against the bottom side of paper web 1, whereas in the second set of rolls 20 the corresponding highly heated steel roll 2 presses against the top side of the web 1.

At least one of the interacting rolls 2, 3 of each set of rolls 10,20 may be controlled to accommodate for bending. To protect the coating 4 of the soft roll 3, the paper web 1 may be wider than needed, i.e., wider than the width of the coating 4 such that the coating 4 never directly contacts the highly heated roll 2. After the treatment is completed, the outer edges of the web may be discarded.

As shown in the drawing FIGURE, the paper web 1, typically having a moisture content of 5 to 15%, initially is conducted from the left through a cooling apparatus 5, which, for example, blows cold air onto the surface of the web to lower its temperature, for example, below ambient temperature, assuming that the paper web 1 previously was at ambient temperature.

The cooled paper web 1 then is conducted vertically downward over a guide roller 6 and passes a heating device 7, which, for example, may be a radiant heating arrangement. As a result of the heat transfer from heating device 7, a temperature rise occurs at the side of the web that faces toward the highly heated hard roll 2 when the paper web is conducted through the set of rolls 10. This is the bottom side of the web in the illustrated embodiment. After passing the vertical section of the web path where the heating device 7 is located, the paper web 1 is fed over a vertically movable guide roller 8. Thereafter, paper web 1 enters into the roll gap or nip 9 formed between the first set of rolls 10. The purpose of the vertical movable guide roller 8 is to change the looping angle $\alpha$ of the highly heated hard roll 2. This effectuates a change in the contact time between the web and roll 2 to adjust the amount of heat transferred from the roll 2 to the bottom side of the paper web 1, which as noted above is the side to be smoothed in the nip 9.

The effect of the treatment in the nip 9 on the bottom side of the paper web 1, i.e., the degree of smoothness is measured by a smoothness sensing device 11. Sensing device 11 sends signals that are processed in a controller 12, which controls the vertical position of the guide roller 8, and consequently, the looping angle $\alpha$.

As the paper web 1 exits the nip 9, the temperature on its bottom side is considerably high. This high temperature normally spreads to the inner layers of the paper web 1. To prevent heat transfer to these inner layers, the paper web 1 is guided over a cooling roll 13, which is arranged upstream of the second set of rolls 20. In this manner, the previously highly heated side of the paper web 1 is cooled and heat is withdrawn from the web altogether. The extent of the cooling effect can be controlled by changing the looping angle $\beta$ of the cooling roll 13 by means of the guide roller 14, which can be vertically raised and lowered.

Another guide roller 15 is provided in the path of web travel downstream of guide roller 14. Guide roller 15 also can be vertically raised and lowered. The vertical web section formed between the guide rollers 14 and 15 does not change when the position of the guide rollers 14, 15 changes. In this web section, the top side of the paper web 1, which faces the highly heated roll 2 of the second set of rolls 20, also faces a heating device 16 that increases the temperature of the top surface of the paper web 1. The web 1 is conducted with its heated top surface heat into the nip 19 of the second set of rolls 20. The looping angle $\gamma$ of the highly heated roll 2 and, consequently, the smoothing effect on the paper web 1 are determined by the position of the guide roller 15.

The degree of treatment in the nip 19 is controlled by the smoothness sensing device 21, which produces signals that are input into a controller 22 that controls the position of the guide roller 15 and, hence, the looping angle. Temperature sensing devices 17 are provided to avoid overheating the coatings 4 of the rolls 3.

In place of, or in addition to, the cooling devices 5, 13, the soft rolls 3 themselves may be formed as cooled rolls such that one side of the paper web 1 presses against the highly heated hard roll 2 and the other side presses against the cooled roll 3. It is understood that with such an arrangement the looping angle on the hard roll 2 cannot also be changed simultaneously.

All of the above-mentioned cooling devices may be interchanged. For instance, in place of the cooling apparatus 5, the cooling occurring at this location may be accomplished by use of a cooled roll. Conversely, of course, instead of cooled roll 13, a cooling apparatus 5 may be provided. Use of the cooled roll 13 has certain advantages because it selectively presses against the side of the paper web 1 that was heated by the highly heated hard roll 2 of the nip 9. The heating devices 7, 16 are optional and only one or no additional heating devices may be provided.

What is claimed is:

1. A process for producing a smooth and glossy surface on a paper web in a calendar arrangement having at least one set of rolls, including a soft roll and a hard roll forming a nip therebetween through which the paper web is conducted, comprising the steps of:

(a) heating the hard roll to a temperature at which noticeable plasticization of surface fibers of the paper web occurs as the paper web is conducted through the nip;

(b) cooling the paper web before it is conducted into the nip;

(c) heating one side of the paper web after the paper web is cooled and before it enters the nip; and (d) at least partially plasticizing surface fibers on said one side of the paper web by heat transfer from the heated hard roll as the web is conducted through the nip.

2. A process for producing a smooth and glossy surface on a paper web in a calendar arrangement having at least one set of rolls, including a coolable soft roll and a heatable hard roll forming a nip therebetween through which the paper web is conducted, comprising the steps of:

(a) heating the hard roll to a temperature at which noticeable plasticization of surface fibers of the paper web occurs as the paper web is conducted through the nip;

(b) heating one side of the paper web before the paper web enters the nip;

(c) cooling the other side of the paper web to a degree sufficient to remove heat from inner areas of the web by heat transfer to the soft roll as the web is conducted through the nip; and (d) at least partially plasticizing surface fibers on said one side of the paper web by heat transfer from the heated hard roll as the web is conducted through the nip whereby plasticization of fibers of the web is isolated to the surface fibers of the web.

3. A calender arrangement for producing a smooth and glossy surface on a paper web comprising:

a first set of rolls forming a first nip therebetween through which a paper web is conducted, said rolls including a soft roll and a heatable hard roll, which can be heated to a predetermined temperature at which noticeable plasticization of surface fibers of the paper web occurs as the web is conducted through the nip;

a first cooling device for cooling the paper web to a degree sufficient to remove heat from inner areas of the web; and a heating device for heating an outer surface of the paper web on the side of the web to be smoothed in the first nip whereby plasticization of fibers of the web is isolated to the surface fibers of the web.

4. The calender arrangement of claim 3 wherein said first cooling device comprises the soft roll, which is formed as a cooled roll for cooling the web as it is conducted through the first nip.

5. The calender arrangement of claim 3 wherein said first cooling device comprises a separate cooling apparatus disposed upstream of the first nip with respect to the direction of travel of the paper web for cooling the web before it enters the first nip.

6. The calender arrangement of claim 3 further comprising a second set of rolls forming a second nip disposed downstream of the first nip with respect to the direction of travel of the paper web, said second set of rolls including a soft roll and a heatable hard roll which can be heated to a predetermined temperature at which noticeable plasticization of surface fibers of the paper web occurs as the web is conducted through the nip wherein the hard roll of the first set of rolls presses against one side of the paper web as the web is conducted through the first nip and the hard roll of the second set of rolls presses against the other side of the paper web as the web is conducted through the second nip, said first cooling device being disposed upstream of at least the second nip with respect to the direction of travel of the paper web for cooling the web before it enters one of said first and second nips.

7. The calender arrangement of claim 6 further comprising a second cooling device disposed upstream of the first nip with respect to the direction of travel of the paper web for cooling the web before it enters said first nip and wherein said first cooling device is disposed between the first and second nips with respect to the direction of web travel.

8. The calender arrangement of claim 7 wherein at least one of said first and second cooling devices comprises a cool air blower for blowing cool air against the outer surface of at least one side of the paper web.

9. The calender arrangement of claim 6 wherein said first cooling device comprises a cooled roll for cooling the paper web as it is conducted over the cooled roll.

10. The calender arrangement of claim 9 further comprising a selectively movable guide roller disposed upstream of at least the second nip with respect to the direction of roll travel of the paper web for adjusting an angle of contact over which the paper web is looped over the cooled roll.

11. The calender arrangement of claim 6 further comprising a second heating device for heating an outer surface of the paper web on the other side of the web to be smoothed in the second nip, said first heating device being disposed upstream of the first nip and said second heating device being disposed upstream of the second nip with respect to the direction of travel of the paper web.

12. The calender arrangement of claim 11 wherein at least one of said first and second heating devices comprises a radiant heating arrangement.

13. The calender arrangement of claim 11 wherein at least one of said first and second heating devices comprises a hot air blower for blowing a heated gaseous medium onto the paper web.

14. The calender arrangement of claim 11 wherein at least one of said first and second heating devices comprises one of the heatable hard rolls for heating the paper web as it is conducted over the said one heatable hard roll.

15. The calender arrangement of claim 14 further comprising a selectively movable guide roller disposed upstream of the said one heatable hard roll with respect to the direction of travel of the paper web for adjusting an angle of contact over which the paper web is looped over the said one heatable hard roll.

16. The calender arrangement of claim 3 further comprising a selectively movable guide roller disposed upstream of the first nip with respect to the direction of travel of the paper web for adjusting an angle of contact over which the paper web is looped over the heatable hard roll.

17. The calender arrangement of claim 16 further comprising mans for controlling the contact angle in response to the smoothness of the paper web.

18. The calender arrangement of claim 3 wherein the hard roll is formed from steel and the predetermined temperature is between 150° and 250° C.

19. The calender arrangement of claim 18 wherein the soft roll is provided with an outer coating selected from the group consisting essentially of paper and plastic.

20. A calender arrangement for producing a smooth and glossy surface on a paper web comprising:

a first set of rolls forming a first nip therebetween through which a paper web is conducted, said rolls including a soft roll, which is formed as a cooled roll for cooling the web as it si conducted through the first nip, and a heatable hard roll, which can be heated to a predetermined temperature at which noticeable plasticization of surface fibers of the paper web occurs as the web is conducted through the nip; and a cooling apparatus operably separate from the first set of rolls disposed upstream of the first nip with respect to the direction of travel of the paper web for cooling the web before it enters the first nip to a degree sufficient to remove heat from inner areas of the web whereby plasticization of fibers of the web is isolated to the surface fibers of the web.

* * * * *